United States Patent [19]

Mögel

[11] Patent Number: 4,916,939

[45] Date of Patent: Apr. 17, 1990

[54] PROTECTIVE LINING ARRANGEMENT

[76] Inventor: Helmut Mögel, Eduard-Pfeiffer-Str. 30, 7000 Stuttgart 1, Fed. Rep. of Germany

[21] Appl. No.: 124,817

[22] Filed: Nov. 24, 1987

[30] Foreign Application Priority Data

Nov. 28, 1986 [DE] Fed. Rep. of Germany ..... 3640739
Apr. 15, 1987 [DE] Fed. Rep. of Germany ..... 3712881
Jun. 11, 1987 [DE] Fed. Rep. of Germany ..... 3719443

[51] Int. Cl.[4] ..... G01M 3/04

[52] U.S. Cl. ..... 73/49.2; 73/40; 220/1 B; 220/5 A

[58] Field of Search ..... 220/1 B, 5 A, 85 S, 220/420, 469, 445; 73/49.2, 40, 40.7; 340/605

[56] References Cited

U.S. PATENT DOCUMENTS 1,927,255 9/1933 Brown ..... 220/420
3,416,165 12/1968 Pereira ..... 220/5 A
3,444,725 5/1969 Chave ..... 73/40.7
3,712,502 1/1973 Basier et al. ..... 220/5 A
4,041,722 8/1977 Terlesky et al. ..... 52/565
4,380,168 4/1983 Ibe ..... 73/40.5 R
4,524,609 6/1985 Sharp ..... 73/49.2
4,653,312 3/1987 Sharp ..... 73/49.2
4,672,366 6/1987 Butts ..... 73/49.2
4,715,513 12/1987 Shelton, Jr. ..... 220/5 A

FOREIGN PATENT DOCUMENTS 614417 11/1979 Switzerland ..... 220/5 A

*Primary Examiner*—Hezron E. Williams
*Attorney, Agent, or Firm*—Horst M. Kasper

[57] ABSTRACT

A protective lining arrangement, which is intended for use in industrial halls, especially in large-area storage halls, and, on the one hand, is to be capable of being loaded to a high degree by vehicles, machines and stored goods while, on the other hand, is to provide excellent protection against undesirable seepage of hazardous liquid substances into the ground, consists of a plurality of protective lining components which are connected to one another by welded joints. Each of such protective lining components includes an upper plate, a lower plate, and a distancing layer of expanded metal which is interposed between the upper and lower plates and keeps them apart by a predetermined distance, while simultaneously providing between the two plates a gap space having a width corresponding to the predetermined distance. The gap spaces of the protective lining components can be evacuated and are connected via a measuring conduit to a leakage monitoring device.

56 Claims, 2 Drawing Sheets

FIG. 1
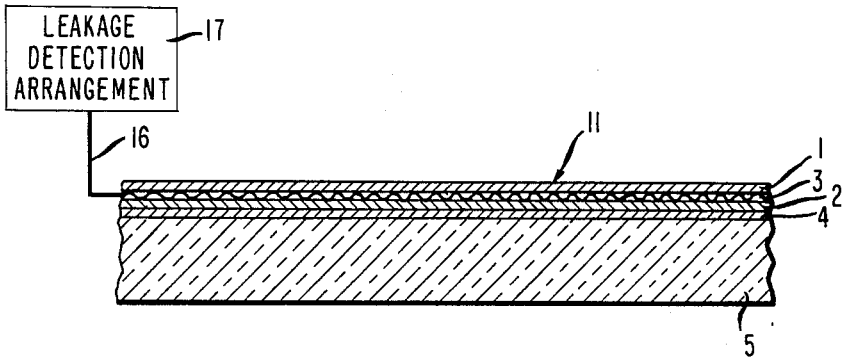
FIG. 2
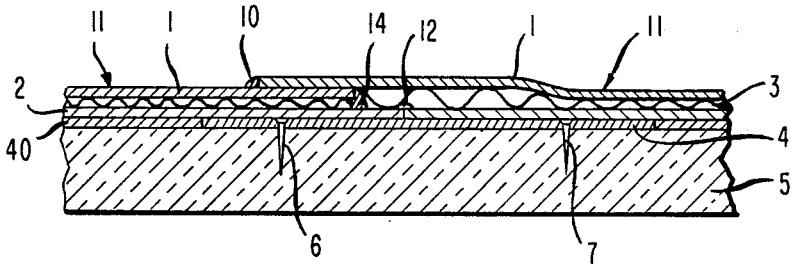
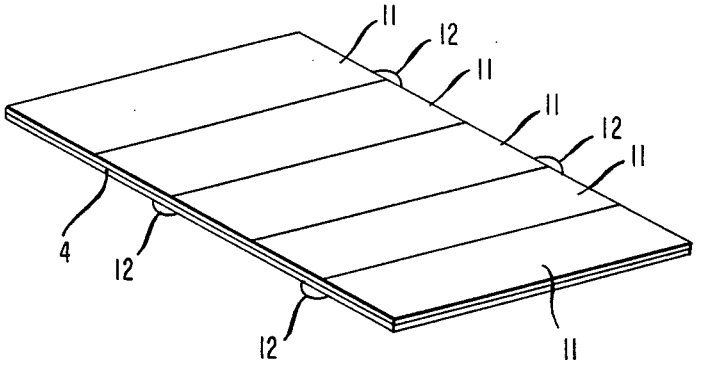
FIG. 3

PROTECTIVE LINING ARRANGEMENT

BACKGROUND OF THE INVENTION

The present invention relates to protective linings in general, and more particularly to a protective lining arrangement for use in industrial halls, especially in large-area storage halls, and which can be mounted on pre-formed foundations or floors, especially on those consisting of concrete.

The pollution of underground water and the resultant endangerment of the potable water by chemical substances, especially by chlorinated hydrocarbons, has been publicized to a large extent over the several past years. The storage of such chemical substances requires especially cautious preventative and monitoring measures, inasmuch as damaging events may occur, as established by experience, as a result of leakage or accidents. To deal with this problem, it has already been proposed to give the floor regions of the storage facilities tub-shaped constructions and configurations, and to use steel structures or concrete with suitable surface coatings for this purpose. Even the filling stations for such environmentally noxious liquid substances must be taken into consideration in this respect, and the aforementioned tub-shaped structures must be used therein. The same considerations are also applicable for the containers for such products.

However, experience has shown that collecting tubs of this kind do not assure sufficient safety against leakage particularly of solvents on the basis of chlorinated hydrocarbons, inasmuch as even small unrecognized leaks result in a permanent environmental damage and inasmuch as concrete is not completely impermeable to such products.

SUMMARY OF THE INVENTION

Accordingly, it is a general object of the present invention to avoid the disadvantages of the prior art.

More particularly, it is an object of the present invention to provide a protective lining arrangement which does not possess the drawbacks of the known arrangements of this type.

Still another object of the present invention is to devise a protective lining arrangement of the type here under consideration which is stable enough to be withstand considerable loading by vehicles, machines or stored goods, and yet is highly resistant to the development of leakage cracks or the like.

It is yet another object of the present invention to design the above arrangement in such a manner as to provide for an early detection and localization of any leakages that may occur despite all precautions, in any event well before the occurrence of any seepage into the ground.

A concomitant object of the present invention is so to construct the arrangement of the above type as to be relatively simple in construction, inexpensive to manufacture, easy to use, and yet reliable in operation.

In keeping with these objects and others which will become apparent hereafter, one feature of the present invention resides in a protective lining arrangement, particularly for industrial halls and especially for large-area storage halls, for mounting on a pre-formed foundation, especially of concrete. This arrangement includes at least one protective lining component including at least one lower plate which is connectable to the foundation, at least one upper plate, and at least one shape-stable distancing layer interposed between the upper and lower plates and separating them from one another while simultaneously forming an air-tightly closable gap space between the upper and lower plates; leakage monitoring means; and means for connecting the leakage monitoring means with the gap space.

The protective lining component, which is constructed in accordance with the present invention so as to be double-walled, is thus provided with a gap space that is filled with a shape-stable and yet air-permeable distancing material and that is gas-tightly closable and connectable to the leakage monitoring device. The upper and the lower plate of the protective lining component may be made of a slightly or highly alloyed steel or of chemically resistant alloys and compounds, such as tombac or, if the loading is correspondingly small, even of welded-together synthetic plastic material webs. The shape-stable material, which is to be loadable in compression and yet still has to be air or gas permeable, can be constituted above all by a metallic mesh, especially by expanded metal mesh. The expanded metal mesh is a punched sheet metal material where apertures are punched as well as metal bending operations are performed in the original sheet metal material in the course of the punching operation. In this manner, there is obtained a mesh-like, three-dimensional structure with a high loadability in compression.

The securing of the protective lining plates is accomplished, in an advantageous manner, by means of holding strips of steel which are connected to the foundation either by dowels or by means of anchors embedded in the concrete foundation already during the formation of the latter. The lower plate of the protective lining component is connected to the holding strip either by point welds or by continuous welded joints. When two adjacent ones of the lower plates are welded in abutment with one another, then they can also be simultaneously welded to the holding strip. Another possibility is that one of the lower plates is welded to the holding strip first, and subsequently the other lower plate is also welded in an overlapping relationship. Advantageously, the lower plates are welded to the holding strip in accordance with a predetermined welding plan in a so-called pilgrim welding process; during the performance of this welding process, short strips are being welded at a distance from one another and in alternation with each other, in order to obtain the smallest possible thermal expansions and stresses. For a further improvement of the adhesion to the foundation, additional holding strips may be provided underneath the lower plate, and these additional holding strips may be welded to the lower plate by welded joints that are provided in bores that are formed in the lower plate.

If it is expected that vapor diffusion will exist from the area of the foundation, then advantageously a vapor barrier layer, for instance in the form of a tarred damping board, is positioned between the foundation and the lower plate.

For the further building-up of the protective lining component, the expanded metal layer is loosely positioned on top of the thus secured lower plate. Subsequently thereto, the upper is positioned on top of the expanded metal layer and is sealingly welded to the lower plate, preferably again in the aforementioned pilgrim welding operation. When the floor or foundation area is large, two or more of the protective lining components are being used. The gap spaces of these components are advantageously separated from one another in a vacuum-tight manner, and they are connectable with one another by respective conduits, for the purpose of leakage detection and leakage search. For these connections, there are advantageously being used U-shaped tubular sections which are connectible to mutually adjacent ones of connecting nipples of each two adjacent ones of the protective lining components.

A slight inclination is advantageously provided in the protective lining during its formation. This slight inclination may lead to and terminate at a drain or sump, from which any liquids which may be present on the top of the protective lining can be more easily exhausted or pumped out. The sump may also be lined by a double-walled jacket or lining of the type discussed above.

In the bottom region, there may be further provided depressions, such as pits, for instance working pits as used in industrial plants, or channels, for instance for the reception of rails. These depressions are also lined with a double-walled protective lining of the above-discussed construction. The pits or channels constitute collection or accumulation regions for possibly escaping chemical substances or liquids, and they are so dimensioned that the contents of, for instance, a drum or another container, or a kettle of a kettle carriage that is to be unloaded there, can be received therein.

For the connection of machines and devices to the protective lining arrangement, bolts or nuts may be welded to the upper plate of the respective component. For the securing of more massive machines and devices, mounting plates are welded to the upper plate, and these mounting plates may then carry, in turn, the mounting nuts or bolts. What is important is that the double-walled protective lining is not drilled through during the mounting of such machines or devices.

The double-walled protective lining may be prefabricated one component after another. In this connection, it is particularly advantageous when the thus prefabricated components are open on one side, and these unilaterally open components are then welded shut by means of a covering strip or an overlapping plate. Correspondingly, the individual pit or channel regions can be prefabricated and only later assembled with one another and with other components.

For the accomplishment of a leakage-proof connection to a wall, the respective protective lining component may be bent upwardly through 90° at its marginal region that is adjacent to the wall in question, and this upwardly bent region can be connected to the associated wall by suitable angled connectors or brackets.

In accordance with a further advantageous aspect of the present invention, the gap spaces of the protective lining can be evacuated through a suction connection, and they are connected to a manometer that is incorporated in the leakage monitoring device. In this arrangement, it is particularly advantageous when the suction conduit is connected at the lowest region of the gap space, and when the measuring conduit is connected at the highest region of the gap space. A liquid lock may be incorporated in the suction conduit. This liquid lock serves for preventing any liquid which may be drawn into the suction conduit from reaching the leakage monitoring device. In addition thereto, detonation prevention devices may be provided in the suction conduit and/or in the measuring conduit. These devices or barriers prevent flame or conflagration propagation from one of the regions to another.

A closable filling and/or testing nipple may be provided at a region of the gap space which is remote from the measuring conduit connection and may be used for admitting testing gas into and/or for the testing of the entire protective lining arrangement. This nipple may be used for supplying, for instance, an inert gas, such as nitrogen, into the gap space for leakage detection or for filling such gap space, prior to its evacuation, with such inert gas for corrosion reduction.

When a leakage occurs, then the gap spaces of the individual protective lining components can be separately connected, for the purpose of leakage location search, to the leakage monitoring device, and they may be thus tested for integrity and absence of leaks. The same result can be achieved in that the gap spaces of the respective protective lining components are disconnected one after the other from the assembly of such gap spaces, and the thus obtained partial gap space assemblies are connected to the leakage monitoring device and tested for their absence of leaks. In this manner, the location of any leak, or the region of occurrence of such a leak, can be found relatively quickly even in huge industrial halls.

BRIEF DESCRIPTION OF THE DRAWING

The present invention will be described below in more detail with reference to the accompanying drawing in which:

FIG. 1 is a sectional view of a fragment of a protective lining component of the present invention, taken in a vertical plane;

FIG. 2 is a view similar to FIG. 1 but taken at an abutment region of two adjacent protective lining components;

FIG. 3 is a perspective view from above of a protective floor lining constituted by a plurality of adjacent protective lining components of FIGS. 1 and 2.

DETAILED DESCRIPTION OF THE PREFERRED EMBODIMENT

Figure 4:
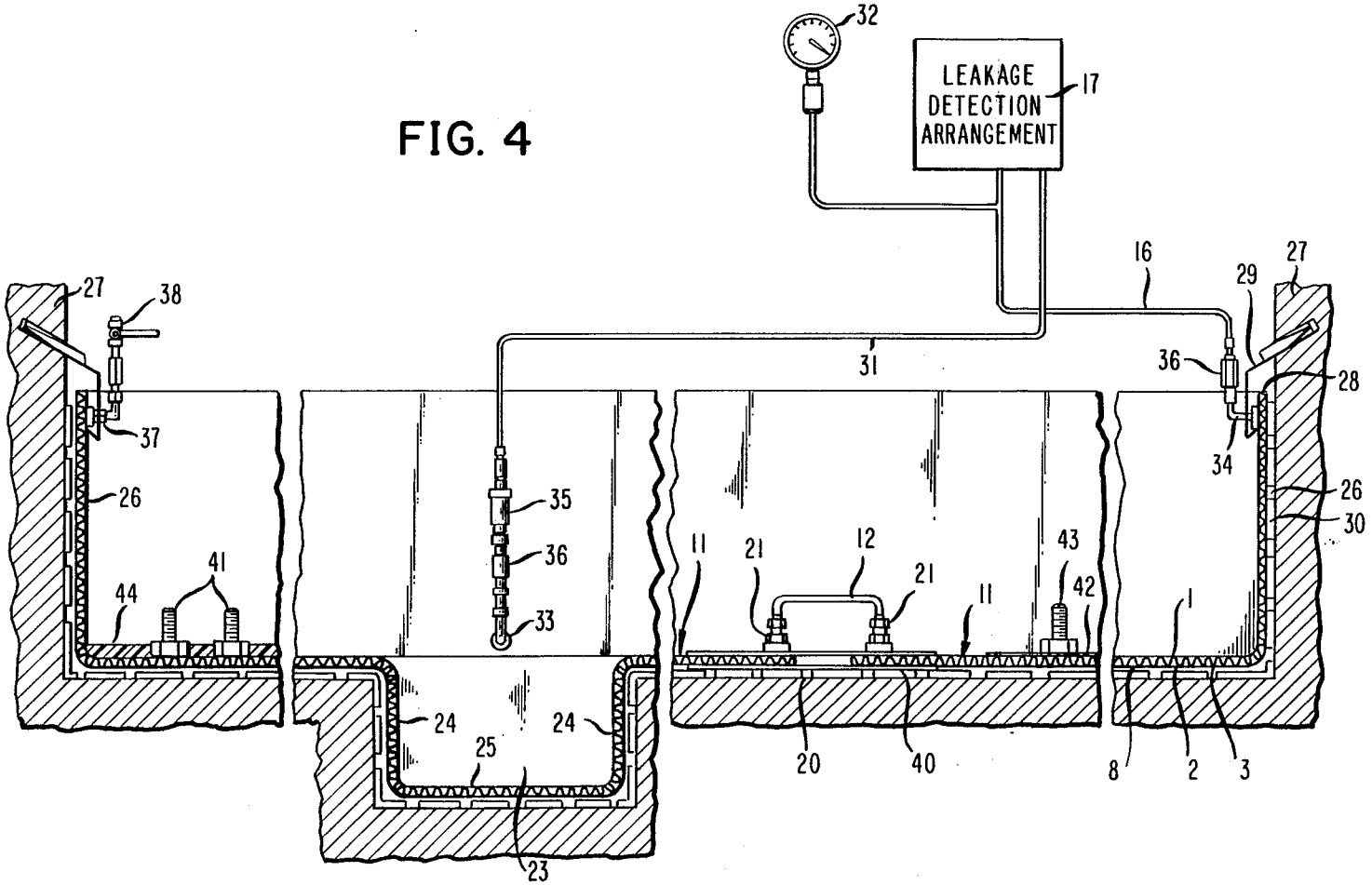
FIG. 4 is a partially sectioned view of a floor region of an industrial hall with the protective lining arrangement of the present invention installed therein.

Referring now to the drawing in detail, and first to FIG. 1 thereof, it may be seen that the reference numeral 11 has been used therein to identify one of many components of a floor covering or of a similar protective lining. The component 11 consists essentially of an upper plate 1 and a lower plate 2, as well as of a distancing layer 3 which is interposed between the upper plate 1 and the lower plate 2. The upper plate 1 and the lower plate 2 are advantageously made of a relatively thick metal sheet, preferably of steel, while the distancing layer 3 is constituted by or made of expanded metal. The expanded metal of the distancing layer 3 has a mesh-like, three-dimensional structure exhibiting a high transverse loadability.

Webs can be arranged in a plurality of layers that are welded to one another.

Because of the presence of apertures and bent metal portions in the expanded metal of the distancing layer 3, the layer 3 is permeable to air and other gaseous media, as well as to liquids, so that a continuous gap space 8 is present between the upper plate 1 and the lower plate 2. This gap space 8 may be either evacuated or filled with a gaseous medium. The lower plate 2 of the protective lining can and will be connected in use by welding to holding strips 4 which are advantageously also made of steel and which, in turn, are connected by respective screws 6 and 7 to a pre-formed concrete foundation. The evacuatable gap space 8 is connected by means of a measurement conduit 16 to a leakage detection arrangement 17.

At least one holding strip (4) situated underneath a portion of said lower plate (2) and connected to said foundation (5). Said lower plate (2) has at least one opening therein which is bounded by a rim at which said lower plate (2) can be welded to said holding strip (4).

It may be seen particularly in FIG. 2 of the drawing that two adjacent ones of the components 11 of the protective lining are connected with another at their regions at which they abut one another and are also secured to the foundation 5. The connecting screws 6 and 7 penetrate through the holding strip 4 at regions that are transversely offset from the center of the holding strip 4, either in an offset relationship, or in a parallel relationship, with respect to one another. As a result of this transversely offset arrangement of the screws 6 and 7, there is obtained an integral central region of the holding strip 4 which is not damaged by the presence of any screw-receiving holes that could eventually constitute leakage locations. The lower plates 2 of the two adjacent protective lining components 11 are welded to one another in abutment with each other and are also weldedly connected, by the same welding seam, to the holding strip 4. The expanded metal distancing layers 3 are then placed from above onto the adjacent lower plates 2 that are connected in this manner to the concrete foundation or floor 5.

Subsequently thereto, the upper plate 1 that is situated at left in FIG. 2 of the drawing is placed from above onto the associated distancing layer 2 and is sealingly welded at its edge region by means of a continuous welding seam 14 to the associated lower plate 2 that is situated thereunder. Simultaneously therewith, even the respective expanded metal distancing layer 3 is welded to the associated plates 1 and 2. After this operation is completed, the upper plate 1 which is illustrated at the right in FIG. 2 of the drawing is positioned from above onto the thus obtained assembly, in such a manner that its marginal or edge portion overlaps the left-hand upper plate 1. Thereafter, the right-hand and the left-hand upper plates 1 are weldingly connected to one another by means of a continuous sealing welding joint 10.

In this manner, there are obtained two of the gap spaces 8, the width (vertical dimension) of which is determined by the wall thickness of the expanded metal distancing layers 3. When corresponding sealing welded joints are provided at the remaining three sides of each of the protective lining components 11, these two gap spaces 8 can be separately evacuated. The two gap spaces 8 are separated from one another as far as their evacuation is concerned, but they can be connected with one another for the purpose of leakage detection and leakage search. U-shaped tubular sections 12 are being used for connecting such neighboring gap spaces 8 with one another. The tubular sections 12 are connected to mutually adjacent connecting nipples of two adjacent ones of the protective lining components 11. A floor protection lining assembly which is illustrated in FIG. 3 of the drawing includes five of the protective lining components 11 which are welded to one another at their regions at which they abut one another, and the gap spaces 8 of which are connected in series by means of the respective tubular sections 12.

An example of the structure of the protective lining arrangement of the present invention is illustrated in FIG. 4 of the drawing. In this implementation of the present invention, there is provided a plurality of the protective lining elements 11 which are connected with one another at respective abutment regions 20 at which they abut one another. The protective lining components 11 are constructed in the above-discussed manner so as to be double-walled, and each of them includes, situated between and embraced by the upper plate 1 and the lower plate 2, the aforementioned distancing layer 3 made of expanded metal, and the gap space 8. The gap spaces 8 are connected with one another at the respective connecting nipples by respective U-shaped tubular sections or members 12.

One of the protective lining components 11 is provided with a depression 23 which constitutes a pump drain. Respective lateral lining portions 24 and bottom lining portion 25 which together bound the depression 23 are also double-walled and have the evacuatable gap space 8. At the regions of respective side walls 27 of the factory or storage hall or bay, the marginal portions of the respective protective lining components 11 are bent upwardly through 90° and, in this manner, they form a tub rim wall 26 which has a height, for instance, of 10 to 40 centimeters. A runoff sheet metal member 29, which is secured to the respective side wall 27, overlaps and embraces an upper edge region 28 of the rim wall 26, so that any liquid which may flow downwardly on the side wall 27 does not penetrated into an interspace 30 present between the protective lining and the side wall 27; rather, such liquid will flow on the runoff sheet metal member 25 onto the supervised or monitored floor protection lining. A tar-coated damping board 40 prevents vapor diffusion from the foundation 5 into the protective lining.

At least one additional protective lining component similar to the protective lining component and having an additional gap space (8). The additional gap space (8) is gas-tightly separated from said gap space (8). Said connecting means includes a separate measuring conduit (16) for each of said gap spaces (8). A separate suction conduit (31) is furnished for each of said gap spaces (8) as well as means for establishing communication between said measuring conduit (16) and suction conduit (31) and said leakage monitoring means (32).

The gap space 8 of the protective lining is connected, by means of a suction conduit 31 and the aforementioned measuring conduit 16, with the leakage detection arrangement 17 which includes a subatmospheric pressure measuring device 32. A suction conduit connection 33 for the suction conduit 31 is disposed at the vicinity of the lowest or deepest point of the protective lining, whereas the measuring conduit 16 is connected to the gap space 8 at a highest point region 34 of the gap space 8. A liquid lock 35 is interposed in the suction conduit 31. The liquid lock 31 serves for the prevention of drawing-in liquid in the event of occurrence of a leakage. Furthermore, detonation safety devices 36 are provided both in the suction conduit 31 and in the measuring conduit 16. These detonation safety devices 36 serve in the event of fire for the prevention of penetration of flames or conflagration from one region to the other. A filling and testing nipple 37 is arranged at a side of the upwardly bent tub rim 26 of the protective lining that is opposite to the measuring conduit line connection 34.

The filling and testing nipple 37 can be closed by means of a ball tap 38, and it may be supplied, for leakage control or testing of the entire protective lining, with an inert gas which consists, for instance, or nitrogen.

For securing of machines or devices on the protective lining components 11, bolts 41 or nuts can be welded to the respective upper plates 1. For larger devices and machines, mounting plates 42 are welded to the upper plate or plates 1, and these mounting plates 42 then, in turn, carry mounting bolts 43 or nuts.

The upper plate 1 may be constructed or configured as a sandwich plate which is provided with a covering 44 of a synthetic plastic material. This synthetic plastic material covering 44 may be applied to the upper plate or plates 1 by being painted on, welded to, glued to, or poured onto the upper plate or plates 1. It is also possible for the covering 44 to be constituted by an industrial flooring, a synthetic resin coating, or a paint layer, or for such flooring, coating or layer to be applied over the upper surface of the covering 44. The industrial flooring may be made, for instance, on a cement or synthetic resin/cement basis. The coating is to be particularly chemically inactive and is to prevent the formation of sparks, as they would develop, for example, if forklift trucks were driven on metallic flooring and if their prongs were allowed to come into contact with and rub against such metallic flooring, or if handling steel sheet bundles or containers and allowing them to slide along a metallic flooring with attendant friction. The protective lining as described above is particularly intended for use in industrial or storage halls or bays, in which explosion protection is to be assured as well.

While the present invention has been described and illustrated herein as embodied in a specific construction of a floor lining for industrial uses, it is not limited to the details of this particular construction, since various modifications and structural changes are possible and contemplated by the present invention. Thus, the scope of the present invention will be determined exclusively by the appended claims.

What is claimed is:

1. A protective lining arrangement, particularly for industrial halls and especially for large-area halls, for mounting on a preformed foundation, especially of concrete, comprising at least one protective lining component including at least one lower plate which is connectable to the foundation, at least one upper plate, and at least one shape- stable distancing layer interposed between said upper and lower plates and separating them from one another while simultaneously forming an air-tightly closable gap space between said upper and lower plates, wherein said distancing layer is constructed as an expanded metal mesh, with a three-dimensional mesh-like structure made of a sheet metal material having apertures and bent portions;

leakage monitoring means;

means for connecting said leakage monitoring means with said gap space;

a holding strip and means for securing said holding strip to the foundation; and wherein said lower plate of said protective lining component is rigidly connected to said holding strip in an at least partially overlapping relationship to said holding strip.

2. The protective lining arrangement as defined in claim 1, wherein at least one of said plates is of sheet metal.

3. The protective lining arrangement as defined in claim 2, wherein said sheet metal is steel.

4. The protective lining arrangement as defined in claim 1, wherein the apertures are punched and wherein the bent portions exhibit a high transverse loadability and are permeable to gaseous and liquid media.

5. The protective lining arrangement as defined in claim 1, wherein said outer edges of said lower plates of said protective lining components are disposed such that said outer edges are spaced from one another when connected to said holding strip.

6. The protective lining arrangement as defined in claim 1, and further comprising elongated sealing welded joints which connect said upper plate with said lower plate while leaving said gap space between said upper and lower plates.

7. The protective lining arrangement as defined in claim 6, wherein said elongated sealing welded joints also connect said upper plate with said distancing layer.

8. The protective lining arrangement as defined in claim 1, wherein said outer edges of said lower plates of said protective lining components abut one another when connected to said holding strip.

9. The protective lining arrangement as defined in claim 1, further comprising a suction connection which communicates with said gap space and through which said gap space can be evacuated; wherein said leakage monitoring means includes a manometer; and wherein said connecting means includes a measuring conduit which connects said gap space with said manometer.

10. The protective lining arrangement as defined in claim 1, wherein said outer edges of said lower plates of said protective lining components overlap one another when connected to said holding strip.

11. The protective lining arrangement as defined in claim 1, wherein said securing means includes mechanical connecting elements selected from the group consisting of dowels, screws and anchors.

12. The protective lining arrangement as defined in claim 1, wherein said lower plate of said protective lining component is welded to said holding strip.

13. The protective lining arrangement particularly for industrial halls and especially for large-area halls, for mounting on a pre-formed foundation, especially of concrete, comprising at least one protective lining component including at least one lower plate which is connectable to the foundation, at least one upper plate, and at least one shape- stable distancing layer interposed between said upper and lower plates and separating them from one another while simultaneously forming an air-tightly closable gap space between said upper and lower plates, wherein said distancing layer is constructed as an expanded metal mesh of steel;

leakage monitoring means;

means for connecting said leakage monitoring means with said gap space, a holding strip and means for securing said holding strip to the foundation; and wherein said lower plate of said protective lining component is rigidly connected to said holding strip in an at least partially overlapping relationship to said holding strip;

at least one additional protective lining component similar to said protective lining component and positioned so that associated outer edges of said lower plate of said protective lining components adjoin one another and are situated on and connected to said holding strip.

14. The protective lining arrangement as defined in claim 13, wherein said outer edges of said lower plates of said protective lining components are disposed such that said outer edges are spaced from one another when connected to said holding strip.

15. The protective lining arrangement as defined in claim 13, wherein said outer edges of said lower plates of said protective lining components abut one another when connected to said holding strip.

16. The protective lining arrangement as defined in claim 13, wherein said outer edges of said lower plates of said protective lining components overlap one another when connected to said holding strip.

17. The protective lining arrangement as defined in claim 13, wherein said outer edges of said lower plates of said protective lining components are connected to said holding strip by welded joints.

18. The protective lining arrangement as defined in claim 13, wherein respective outer edges of said upper plates of said protective lining components are connected to corresponding ones of said outer edges of said lower plates.

19. The protective lining arrangement as defined in claim 18, wherein said outer edges of said upper plates of said protective lining components are connected to corresponding ones of said outer edges of said lower plates by respective welded joints.

20. A protective lining arrangement particularly for industrial halls and especially for large-area halls, for mounting on a pre-formed foundation, especially of concrete, comprising at least one protective lining component including at least one lower plate which is connectable to the foundation, at least one upper plate, and at least one shape- stable distancing layer interposed between said upper and lower plates and separating them from one another while simultaneously forming an air-tightly closable gap space between said upper plate and said lower plate;

leakage monitoring means; and means for connecting said leakage monitoring means with said gap space;

a holding strip and means for securing said holding strip to the foundation, and wherein said lower plate of said protective lining component is rigidly connected to said holding strip in an at least partially overlapping relationship to said holding strip;

at least one additional protective lining component similar to said protective lining component and positioned so that associated outer edges of said lower plate of said protective lining components adjoin one another and are situated on and connected to said holding strip; and wherein respective outer edges of said upper plate of said protective lining components are connected to corresponding ones of said outer edges of said lower plate;

wherein said outer edges of said upper plate of said protective lining components are connected to corresponding ones of said outer edges of said lower plate by respective welded joints; and wherein said outer edge of said upper plate of one of said protective lining components is directly connected to said outer edge of the corresponding one of said lower plate, whereas said outer edge of said upper plate of the other of said protective lining component overlaps said outer edge of said one protective lining component and is sealingly connected thereto.

21. The protective lining arrangement as defined in claim 20, wherein the connection of said outer edge of said upper plate of said other protective lining component to said outer edge of said one protective lining component is a sealing welded connection.

22. A protective lining arrangement particularly for industrial halls and especially for large-area halls, for mounting on a pre-formed foundation, especially of concrete, comprising at least one protective lining component including at least one lower plate which is connectable to the foundation, at least one upper plate, and at least one shape- stable distancing layer interposed between said upper plate and said lower plate and separating them from one another while simultaneously forming an air-tightly closable gap space between said upper plate and said lower plate; leakage monitoring means; and means for connecting said leakage monitoring means with said gap space;

a holding strip and means for securing said holding strip to the foundation, and wherein said lower plate of said protective lining component is rigidly connected to said holding strip in an at least partially overlapping relationship to said holding strip;

at least one additional protective lining component similar to said protective lining component and positioned so that associated outer edges of said lower plate of said protective lining components adjoin one another and are situated on and connected to said holding strip; and wherein respective outer edges of said upper plate of said protective lining components are connected to corresponding ones of said outer edges of said lower plate;

wherein said outer edges of said upper plate of said protective lining components are connected to corresponding ones of said outer edges of said lower plate by respective welded joints; and further comprising a covering member which is connected to said upper plate of said protective lining components and covers the region at which said outer edges of said upper plate of said protective lining component adjoin one another.

23. A protective lining arrangement, particularly for industrial halls and especially for large-area halls, for mounting on a pre-formed foundation, especially of concrete, comprising at least one protective lining component including at least one lower plate which is connectable to the foundation;

a holding strip and means for securing said holding strip to the foundation, wherein said lower plate of said protective lining component is rigidly connected to said holding strip in an at least partially overlapping relationship to said holding strip;

at least one upper plate, and at least one shape- stable distancing layer interposed between said upper and lower plates and separating them from one another while simultaneously forming an air-tightly closable gap space between said upper and lower plates; leakage monitoring means;

means for connecting said leakage monitoring means with said gap space; and a vapor barrier layer arranged at the underside of said protective lining component and facing the foundation.

24. The protective lining arrangement as defined in claim 23, wherein said vapor barrier layer is constituted by a tarred board.

25. The protective lining arrangement as defined in claim 1, further comprising at least one additional protective lining component similar to said protective lining component and having an additional gap space that is gas-tightly separated from said gap space; wherein said connecting means includes a separate measuring conduit for each of said gap spaces; and further comprising a separate suction conduit for each of said gap spaces and means for establishing communication between said measuring and suction conduits and said leakage monitoring means.

26. The protective lining arrangement as defined in claim 1, wherein said protective lining component, inclusive of said upper and lower plates and said distancing layer confined therebetween, has a rim portion at least at one marginal portion of said protective lining component, said rim portion extending along a course that is bent upwardly through 90° relative to that of the remainder of said protective lining component to form an upwardly projecting tub rim.

27. The protective lining arrangement as defined in claim 1, wherein said protective lining component, inclusive of said upper and lower plates and said distancing layer confined therebetween, has a depressed portion which is depressed downwardly relative to the remainder of said protective lining component to form side and bottom walls of a depression, said gap space continuing into said side and bottom walls.

28. The protective lining arrangement as defined in claim 27, wherein at least said upper plate merges into said depression with a slight downward inclination.

29. The protective lining arrangement as defined in claim 1, and further comprising a plurality of mounting elements arranged at and projecting upwardly from said upper plate of said protective lining component.

30. The protective lining arrangement as defined in claim 28, wherein said mounting elements are selected from the group consisting of bolts and nuts.

31. The protective lining arrangement as defined in claim 28, wherein said mounting elements are welded to said upper plate.

32. The protective lining arrangement as defined in claim 1, and further comprising a mounting plate secured to said upper plate and a plurality of mounting elements arranged at and projecting upwardly from said mounting plate.

33. The protective lining arrangement as defined in claim 32, wherein said mounting plate is secured to said upper plate by welded joints.

34. The protective lining arrangement as defined in claim 32, wherein said mounting elements are selected from the group consisting of bolts and nuts.

35. The protective lining arrangement as defined in claim 28, wherein said mounting elements are welded to said mounting plate.

36. The protective lining arrangement as defined in claim 1, and further comprising rails for rail-supported vehicles, said rails being mounted on said upper plate.

37. The protective lining arrangement as defined in claim 1, wherein said protective lining component has at least some portions which deviate from a substantially horizontal plane of said protective lining component; wherein said connecting means includes a measuring conduit which is connected to said gap space at a highest region thereof; and further comprising a suction conduit connected to said gap space at a lower region thereof.

38. The protective lining arrangement as defined in claim 1, and further comprising a suction conduit communicating with said gap space, and a liquid lock interposed in said suction conduit.

39. The protective lining arrangement as defined in claim 1, wherein said connecting means includes a measuring conduit; and further comprising a suction conduit connected to said gap space, and at least one detonation protection device interposed at least in one of said measuring and suction conduits.

40. The protective lining arrangement as defined in claim 1, and further comprising a closable filling and testing nipple situated at and communicating with a region of said gap space that is remote from said connecting means, said nipple serving for at least one of filling said gap space with a testing gas and the testing of the entire arrangement for leakage.

41. The protective lining arrangement as defined in claim 1, and further comprising means for admitting an inert gas into said gap space.

42. A protective lining arrangement, particularly for industrial halls and especially for large-area halls, for mounting on a pre-formed foundation, especially of concrete, comprising at least one protective lining component including at least one lower plate which is connectable to the foundation, at least one holding strip situated underneath a portion of said lower plate and connected to said foundation; and wherein said lower plate has at least one opening therein which is bounded by a rim at which said lower plate can be welded to said holding strip, at least one upper plate, at least one shape- stable distancing layer interposed between said upper and lower plates and separating them from one another while simultaneously forming an air-tightly closable gap space between said upper and lower plates, wherein said distancing layer is constructed as an expanded metal mesh, with a three-dimensional mesh-like structure made of a sheet metal material having apertures and bent portions;

leakage monitoring means; and means for connecting said leakage monitoring means with said gap space.

43. The protective lining arrangement as defined in claim 1, wherein at least one of said upper and lower plates is provided with a synthetic plastic material layer that is applied thereto.

44. The protective lining arrangement as defined in claim 43, wherein said synthetic plastic material layer is applied to said one plate by one of painting, welding, gluing and pouring.

45. A protective lining arrangement, particularly for industrial halls and especially for large-area halls, for mounting on a pre-formed foundation, especially of concrete, comprising at least one protective lining component including at least one lower plate which is connectable to the foundation, at least one upper plate, at least one shape- stable distancing layer interposed between said upper and lower plates and separating them from one another while simultaneously forming an air-tightly closable gap space between said upper and lower plates, wherein said distancing layer is constructed as an expanded metal mesh, with a three-dimensional mesh-like structure made of a sheet metal material having apertures and bent portions;

an industrial flooring applied to the upper surface of said upper layer and having one of synthetic resin, cement and synthetic cement basis;

leakage monitoring means; and means for connecting said leakage monitoring means with said gap space.

46. The protective lining arrangement as defined in claim 1, wherein at least one of said upper and lower plates consists of a plurality of synthetic plastic material webs.

47. The protective lining arrangement as defined in claim 1, wherein said outer edges of said lower plates of said protective lining components are connected to said holding strip by welded joints.

48. The protective lining arrangement as defined in claim 1, wherein respective outer edges of said upper plates of said protective lining components are connected to corresponding ones of said outer edges of said lower plates.

49. The protective lining arrangement as defined in claim 1, wherein at least one of said upper and lower plates has a wall thickness of at least 2 millimeters.

50. The protective lining arrangement as defined in claim 43, wherein said wall thickness is between 3 and 6 millimeters.

51. The protective lining arrangement as defined in claim 1, wherein the width of said gap space, which is determined by the thickness of said distancing layer, amounts to at least 1 millimeter.

52. The protective lining arrangement as defined in claim 51, wherein said width is between 2 and 3 millimeters.

53. The protective lining arrangement as defined in claim 1, wherein said protective lining component includes an upwardly bent tub rim having a height of at least 50 millimeters.

54. The protective lining arrangement as defined in claim 53, wherein said height is between 70 and 400 millimeters.

55. The protective lining arrangement as defined in claim 1, wherein said outer edges of said upper plates of said protective lining components are connected to corresponding ones of said outer edges of said lower plates by respective welded joints.

56. The protective lining arrangement as defined in claim 1, and further comprising a vapor barrier layer arranged at the underside of said protective lining component and facing the foundation.

* * * * *